United States Patent [19]

De Beer

[11] Patent Number: 5,076,447

[45] Date of Patent: Dec. 31, 1991

[54] HOLDER TO POSITION CLOTHES HANGERS RELATIVE TO ONE ANOTHER

[76] Inventor: Daniel H. De Beer, 61, Maarsbergseweg, Leersum, Netherlands

[21] Appl. No.: 626,787

[22] Filed: Dec. 13, 1990

[30] Foreign Application Priority Data

Dec. 13, 1989 [CH] Switzerland ..... 04483/89

[51] Int. Cl.[5] ..... A47F 5/00

[52] U.S. Cl. ..... 211/123; 211/124

[58] Field of Search ..... 211/124, 123, 8, 89

[56] References Cited

U.S. PATENT DOCUMENTS

| | | | |
|---|---|---|---|
| 2,068,451 | 1/1937 | Elmore | 211/8 X |
| 3,318,460 | 5/1967 | Becker | 211/123 |
| 4,361,241 | 11/1982 | Stoddard | 211/123 |
| 4,732,270 | 3/1988 | Myers et al. | 211/124 X |
| 4,769,878 | 9/1988 | Liao | 211/124 X |
| 4,858,870 | 8/1989 | Mazzanti | 211/124 X |

*Primary Examiner*—Robert W. Gibson, Jr.

*Attorney, Agent, or Firm*—Watson, Cole, Grindle & Watson

[57] ABSTRACT

To prevent clothes hangers from sliding together on a clothes rod during the transport of clothes on said clothes hangers, a holder is provided that exhibits recesses into which hooks of the clothes hangers can be clamped. The device has arms located between eyes having fixation and swivel means. Two holder halves are moulded identically and are preferably made of plastic and can exhibit a prestress.

9 Claims, 4 Drawing Sheets

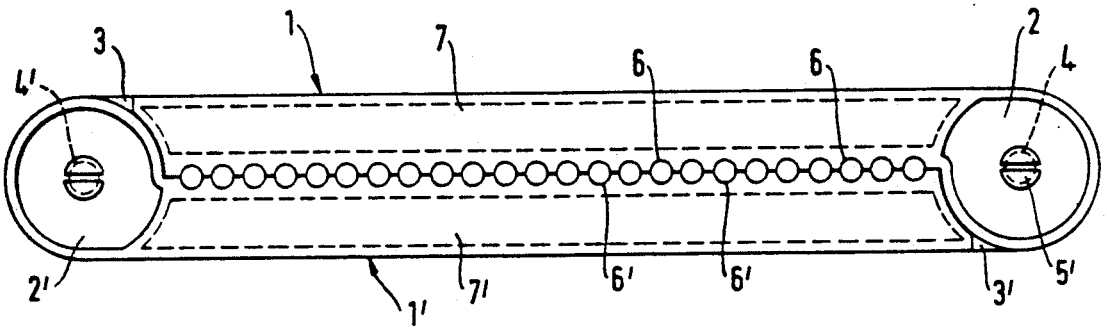
Fig. 1a
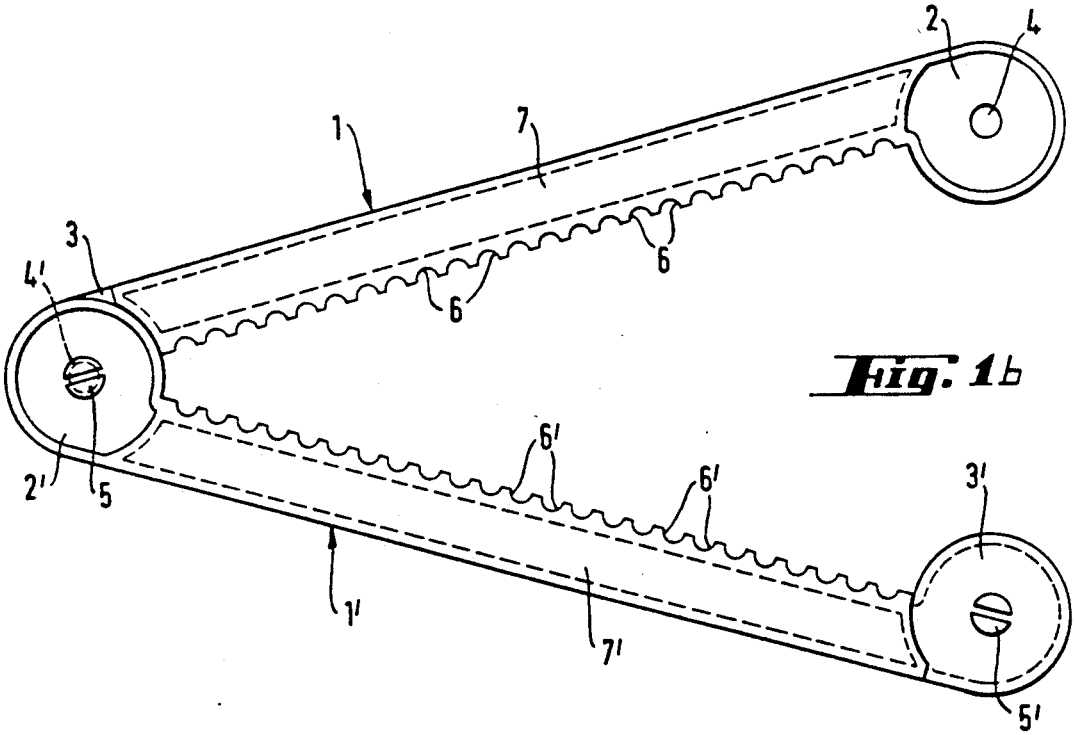
Fig. 1b
Fig. 1c
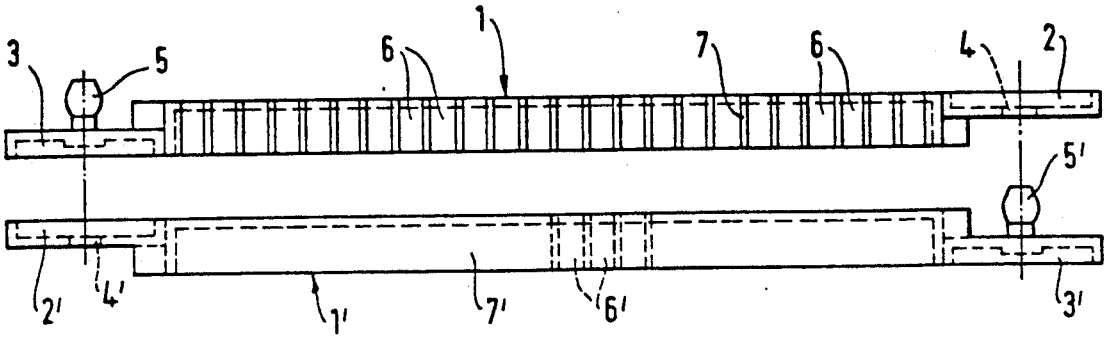

HOLDER TO POSITION CLOTHES HANGERS RELATIVE TO ONE ANOTHER

BACKGROUND OF THE INVENTION

The present invention relates to a holder for positioning clothes hangers laterally relative to one another.

During the transport of clothes or garments located on clothes hangers it is often desired to ensure that the clothes hangers hanging from a clothes rod or the like are not pushed together or otherwise do not make uncontrolled movements relative to one another, since this readily leads to the clothes becoming crumpled. Conventionally, this problem is solved by using clothes rods that have pins, which are inserted at regular intervals at the top and which prevent the clothes hangers from sliding laterally against one another on the rod. Such clothes rods are, however, quite expensive and, in particular, not always available. In addition, they are not quite without problems from a safety point of view. Alternatively, an adhesive tape is wound around several clothes hangers in the hanging vicinity of the hangers in order to create a quasi-stable unit, within which the individual hangers can move only a limited degree relative to one another. This method is, of course, not very practical and only partially fulfills the requirements, since an adhesive tape cannot prevent the clothes hangers located next to one another from sliding together. Resistance is made only to a pull movement, that is, to two adjacent hangers sliding apart.

Therefore, the present invention is based on the problem of developing a holder to position clothes hangers relative to one another, which holder avoids the drawbacks of known means and methods and can be manufactured cost effectively and is simple to use.

These problems are solved by the holders of the present invention.

SUMMARY OF THE INVENTION

The present invention relates to a holder for positioning clothes hangers laterally relative to one another. The holder comprises at least one mechanically rigid, elongated arm provided with recesses which serve to accommodate hooks of clothes hangers.

BRIEF DESCRIPTION OF THE DRAWINGS

In the following description, advantageous embodiments of the holders of the invention are described with reference to the drawings, wherein:

FIG. 1*a* is a top view of a first embodiment of the subject matter of the invention in the closed state;

FIG. 1*b* shows the holder, according to FIG. 1*a*, in the opened state;

FIG. 1*c* is a side view of the two disassembled components of the holder according to FIG. 1*a;*

DETAILED DESCRIPTION OF PREFERRED EMBODIMENTS

Figure 2:
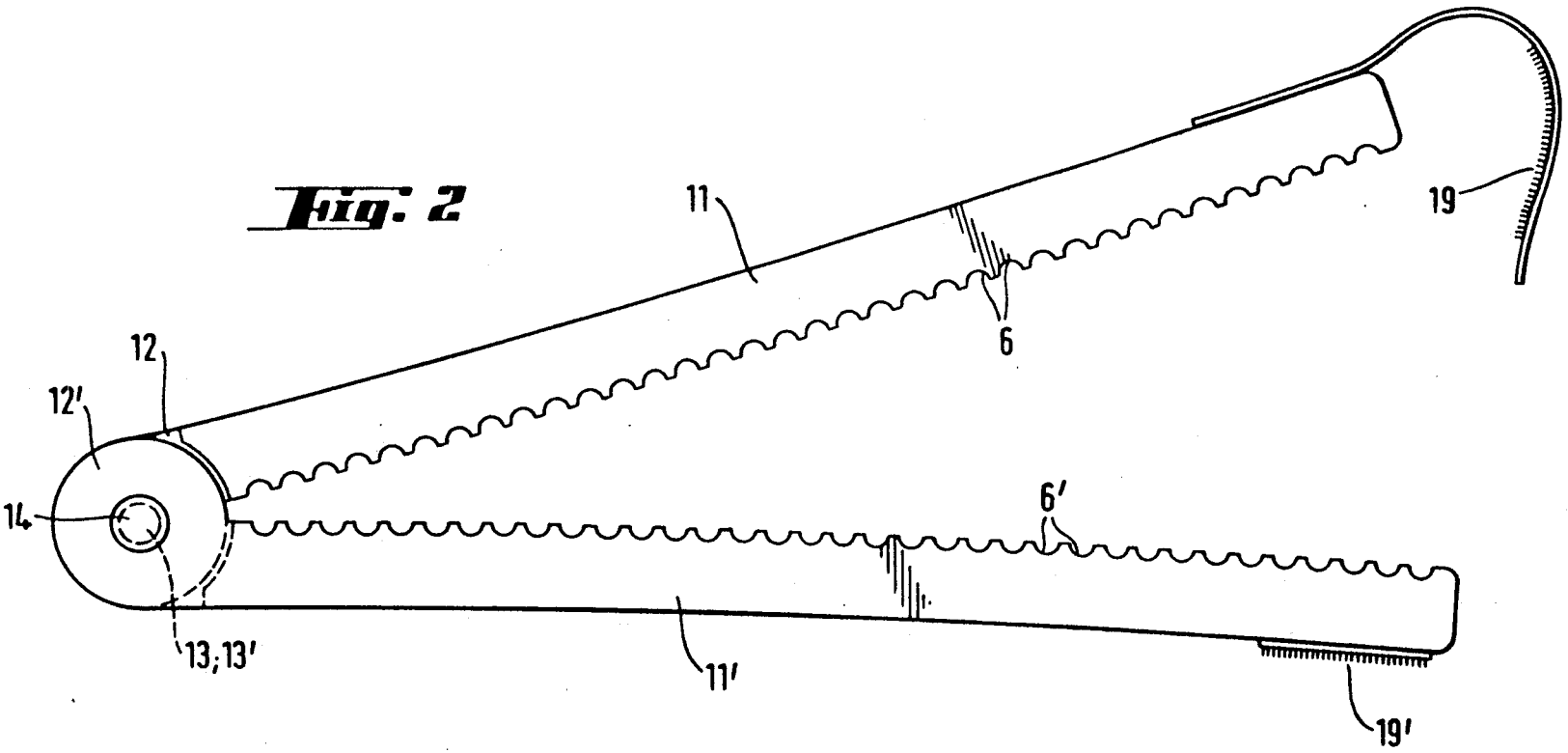
FIG. 2 is a top view of a second embodiment of the present invention.

FIGS. 1*a*, 1*b* and 1*c* show a holder of the invention in a closed, open, and nonassembled state, respectively.

The holder comprises two halves, 1 and 1'. The two holder halves 1, 1' are identical and each one exhibits two eyes 2 and 3, 2' and 3' respectively, of which one bears a central hole, 4, 4' and the other, a central aligning trunion 5, 5' provided to interact with the hole 4, 4'. Each of two eyes 2, 3 and 2', 3' of a holder half 1, 1' respectively, is connected to one another by means of an arm 7, 7' provided on one side with recesses 6, 6'. The opened holder shown in FIG. 1*b* is generated by assembling the two holder halves 1, 1' mirror-invertedly in such a manner that the aligning trunion 5 is inserted, for example, into hole 4'. In so doing, its two holder halves 1, 1' can be pivoted reciprocally around the aligning trunion 5, which is the axis of hole 4'. Due to the fact that the eyes 2, 3, 2' and 3' shown in FIG. 1*c*, are designed approximately half as thick as the arms 7, 7', once connected, the arms lie more or less in one plane.

By slightly forcing laterally apart the eyes 2 and 3' that are not yet connected to one another in such a manner that the eye 2 can be pushed with hole 4 over the aligning trunion 5' of eye 3', the holder of the invention can be brought into the closed state, as shown in FIG. 1*a*. When the holder halves 1, 1' are in this position, the corresponding recesses 6, 6' of both arms 7, 7' form vertical openings in the holder, which, according to FIG. 4, serve to accommodate and mutually position hooks 8 of the clothes hangers 9.

The holder halves 1, 1' are preferably made of plastic and can be injection molded in large quantity cost effectively. In so doing, arms 7, 7' can be designed, depending on the material used, as whole parts or as U-shaped parts. It can be expedient to design them not as straight lines, as compared to FIG. 1, but rather as slightly bent, in such a manner that by closing the holder, prestress is generated that prevents the openings formed by the recesses 6, 6' from being pushed together in their central sections by the forces acting on the hooks 8 owing to the movement of the clothes hanger 9.

It is self-evident that the holders of the invention described above can be of different lengths and designed as solid, depending on the application and need. The two identical halves can be put together automatically or by hand. Due to their simple application, they are far more practical than the conventional method with adhesive tapes. Their arms 7, 7' can be provided with advertisement stickers. The holders of the invention are an optimal solution to the problem on which the invention is based.

FIG. 2 shows another embodiment of a hanger of the invention that differs substantially from the embodiment described above by the fact that the two holder halves 11, 11' exhibit eyes on only one side 12, 12' through whose central holes 13, 13' a pin 14 is directed that is designed in such an advantageous manner that the holder halves cannot be taken apart. This variant of the holder is provided, in an advantageous manner, with clinging strip-closure parts 19, 19' by means of which the holder can be closed on the free ends of the holder halves. In this variant of the holder the holder halves 11, 11' are designed slightly bent, i.e. reciprocally concave, in order to be able to produce a prestress which prevents the undesired forcing open of the openings formed by the recesses 6, 6' for the hooks of the clothes hangers when the holder is in the closed state.

Figure 3:
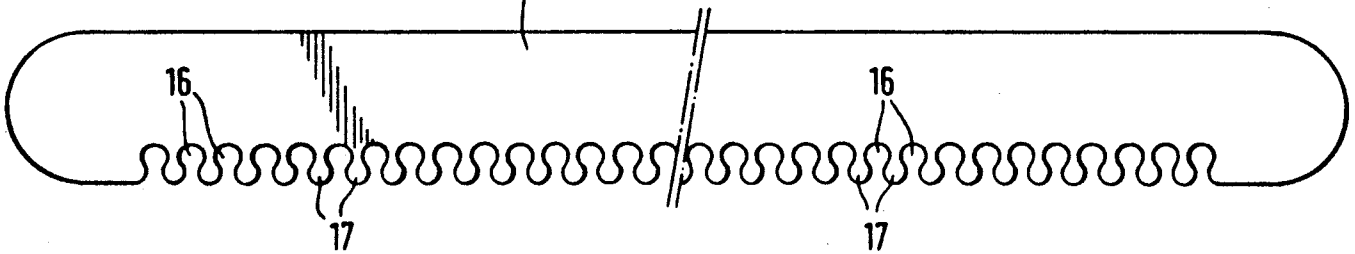
FIG. 3 is a top view of a third embodiment of the subject matter of the invention.

As an alternative, it is also possible in another embodiment of the invention to design the holder as shown in FIG. 3. In so doing, the recesses 16 of the one-piece holder 18 are designed in such a manner that a flexible tongue 17 is formed between each two neighboring recesses 16. The tongues prevent hooks of clothes hangers from sliding out of recesses 16 since they are snapped in behind the tongues. This embodiment of a holder of the present invention can be manufactured most simply and most cost effectively, but does not offer the same reliability in positioning the clothes hangers as the two aforementioned variants according to FIGS. 1 and 2. For blouses, shirts, and other light garments it does, however, overcome the problems associated with the prior art.

Figure 4:
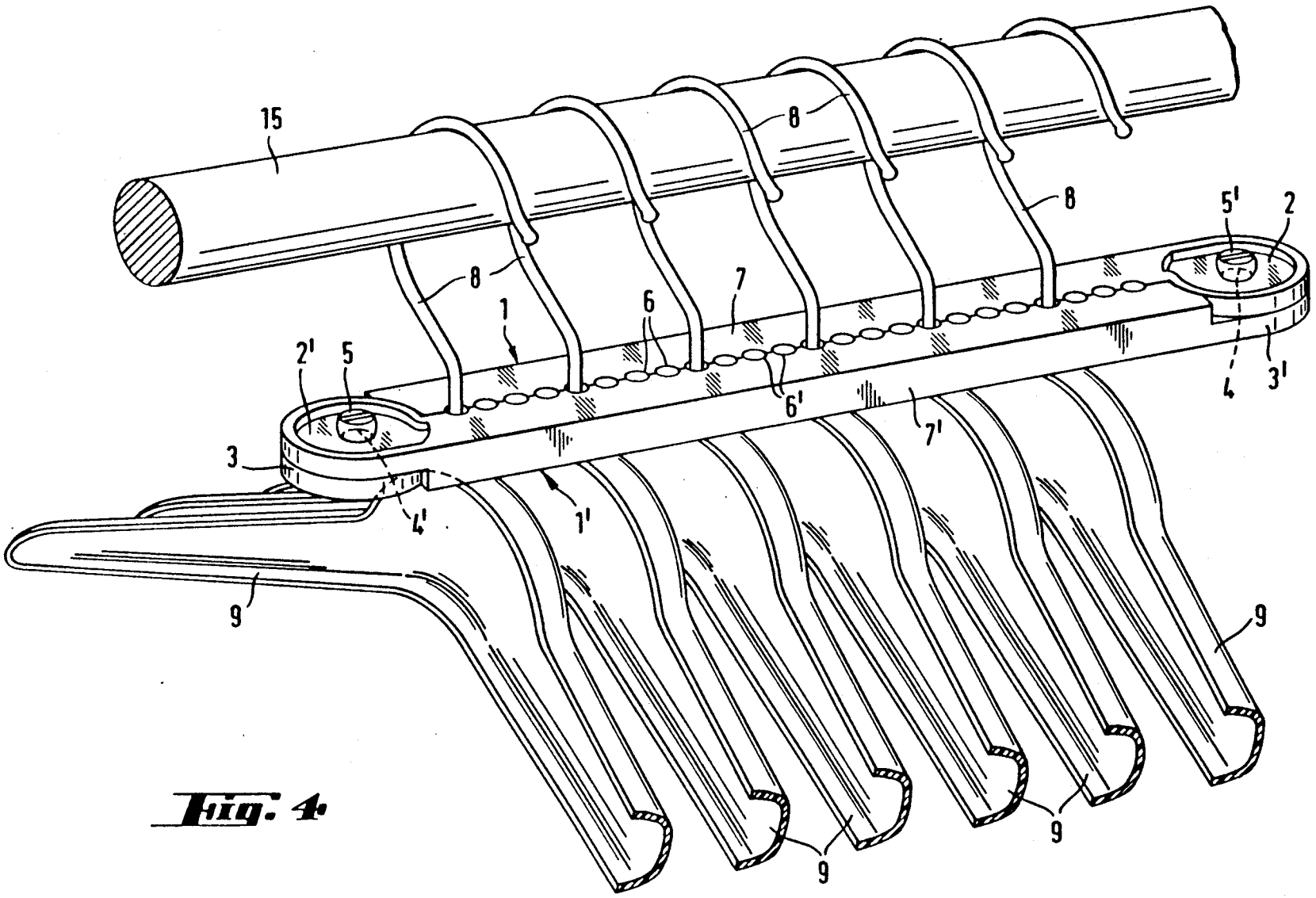
FIG. 4 is a perspective, tilted view of the holder according to FIG. 1 in practical use.
Figure 5:
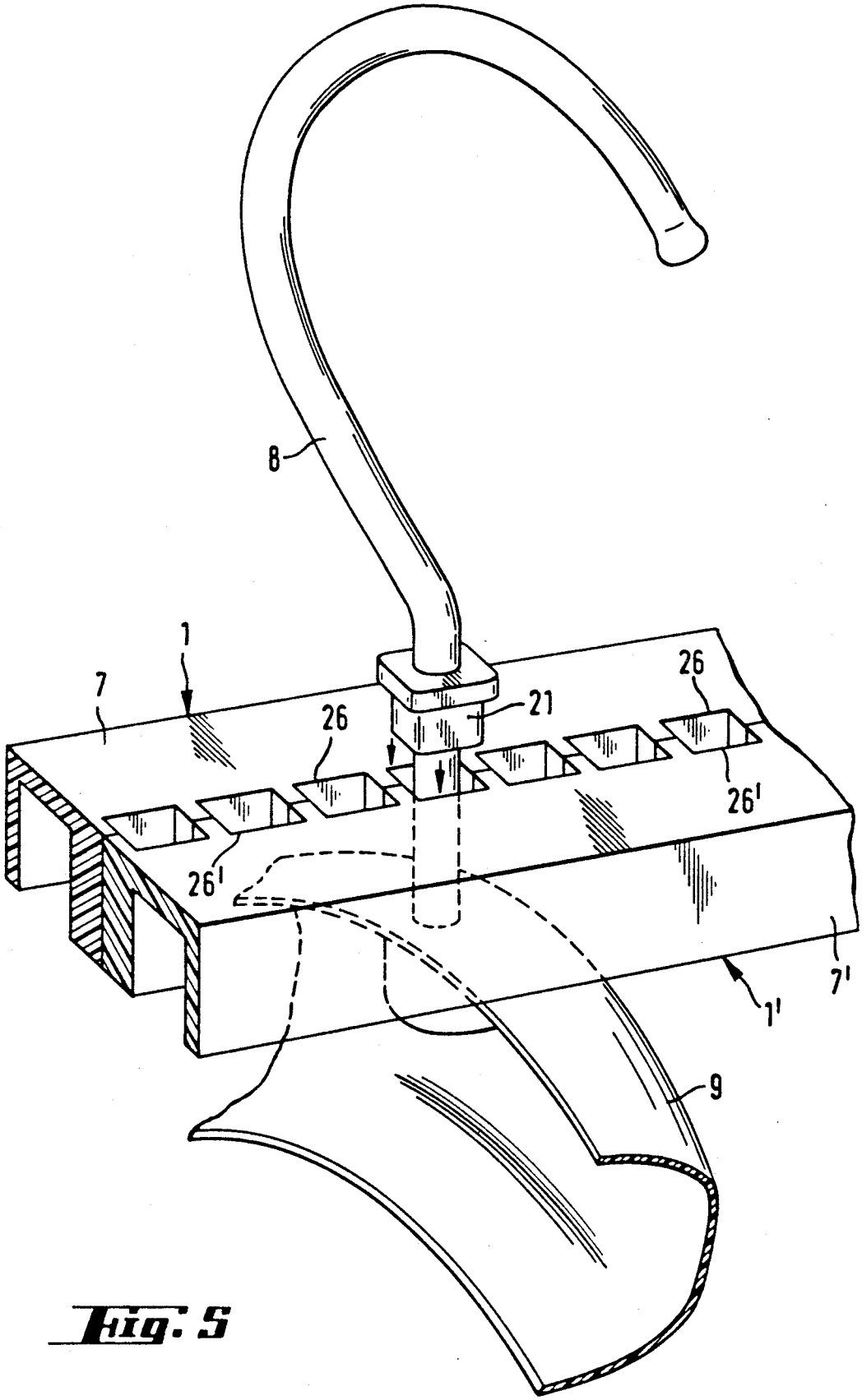
FIG. 5 is a perspective, partial representation of another embodiment, partially pulled apart.

FIG. 4 shows how the clothes hangers 9 hanging on a clothes rod 15 can be positioned relative to one another by means of a holder of the invention. Shown here is a two-part holder according to FIG. 1. In so doing, the holders of the invention can be attached and removed without any problem and at any time by a single person can hold, relative to one another, the clothes hangers 9 by their hooks 8 due to the plurality of recesses 6, 6', at varying intervals adapted to the garments.

Even if in many cases injection moulded plastic suggests itself for the manufacture of the holders of the invention, other materials such as metal and/or metal-coated plastics can also be used. If other clothes hangers with hooks made of a magnetizable metal are used, the holders can be made preferably of such material or at least a magnetic material in areas in which they interact with the hooks in order to prevent the holder from an unwanted displacement at the hooks of the clothes hangers. To this end, it is especially helpful if the clothes hangers exhibit, between the effective hanger and the curvature of the hook, a thickening, which prevents the hooks from being able to slide individually through the holder. Such a design of the hooks of the clothes hangers, which are to be used with the holders of the invention, makes it possible to carry all of the clothes hangers, which are positioned in one holder, by lifting the holder.

Furthermore, it can be useful and logical, according to the invention, to provide, instead of semi-circular grooves, rectangular grooves 26, 26', which interact in such a manner with precisely those parts 21 of the hooks that a twisting of the hooks relative to the clothes hanger is ruled out. This has the advantage that clothes hangers transported only at the holder can be transferred without any problems from one clothes rod to another without the hooks mutually twisting in such a manner that hanging all of the hooks on one clothes rod leads to problems since they are no longer aligned parallel to one another.

It will be appreciated that those of skill in the art recognize that the three variants of the subject matter of the invention described above and shown in the drawings are representative of other embodiments exhibiting the same or similar principle features of construction. Variations, deletion, additions and substitutions may be made without departing from the spirit and scope of the invention. Obviously the detailed features of the holders can be designed differently than in the above description without abandoning the inventive thought.

We claim:

1. A device for interlocking and positioning a plurality of clothes hangers laterally relative to one another, each clothes hanger being usable for the support of at least one garment, said plurality of clothes hangers being arranged on a common first clothes rod, said device comprising two interconnectable arms each of which comprises means to interconnect with the other arm to mutually interlock the clothes hangers, at least one of the arms being provided with a plurality of recesses at an inner side facing the other arm, each recess able to accommodate a portion of a clothes hanger and to lock said portion in the recess upon interconnecting said two arms, said device functioning as an independent second clothes rod for lifting said plurality of clothes hangers as one unit from said first clothes rod for transport purposes.

2. A device as in claim 1, wherein said means to interconnect are molded to eyes which close the arms on the side provided with recesses.

3. A device as in claim 2, wherein the means to interconnect comprise holes and interacting aligning trunions.

4. A device as in claim 1, wherein the means to interconnect comprise surface clinging closure parts.

5. A device as in claim 1, wherein the arms are bent in such a manner that a prestress is generated by pressing said arms together in order to interlock the device.

6. A device as in claim 1, wherein said two arms exhibit recesses which are arranged in such a manner that they form vertical openings in the device when the device is closed.

7. A device as in claim 1, wherein the recesses are molded in such a manner that they form flexible tongues on the side provided with recesses which narrow the opening cross section of the recesses and serve to retain hooks of clothes hangers in the recesses.

8. A device as in claim 1, comprising two identical holder halves, each of which exhibits one of said arms with two eyes of which a first eye bears a hole and a second eye bears an aligning trunion, the thickness of the eyes being approximately half the thickness of the arms.

9. A device as in claim 1, further comprising one or more hangers with hooks having portions which interact with said recesses to prevent rotation of said hangers while in said device.

* * * * *